US010018350B2

(12) United States Patent
Brown

(10) Patent No.: US 10,018,350 B2
(45) **Date of Patent: *Jul. 10, 2018**

(54) CONTAINER APPARATUS AND METHOD OF USING SAME

(71) Applicant: LIT Coolers, LLC, Decatur, AL (US)

(72) Inventor: Matthew S. Brown, Faulkner, MS (US)

(73) Assignee: LIT Coolers, LLC, Decatur, AL (US)

( * ) Notice: Subject to any disclaimer, the term of this patent is extended or adjusted under 35 U.S.C. 154(b) by 756 days.

This patent is subject to a terminal disclaimer.

(21) Appl. No.: 14/534,110

(22) Filed: Nov. 5, 2014

(65) Prior Publication Data

US 2015/0077975 A1 Mar. 19, 2015

Related U.S. Application Data

(63) Continuation-in-part of application No. PCT/US2014/056433, filed on Sep. 19, 2014, and a
(Continued)

(51) Int. Cl.
*F21V 33/00* (2006.01)
*F25D 27/00* (2006.01)
(Continued)

(52) U.S. Cl.
CPC ..... *F21V 33/008* (2013.01); *F21V 33/0044* (2013.01); *F21V 33/0084* (2013.01);
(Continued)

(58) Field of Classification Search
CPC ... A45C 15/06; F25D 27/00; F25D 2331/804; F25D 2400/36; F25D 3/08; F21V 33/008; F21V 33/0044; F21V 33/0084
See application file for complete search history.

(56) References Cited

U.S. PATENT DOCUMENTS 4,984,760 A 1/1991 Cohn et al.
5,768,898 A * 6/1998 Seok ..... F25D 27/00 362/92
(Continued)

FOREIGN PATENT DOCUMENTS

RU 54138 U1 6/2006
RU 78632 U1 12/2008

OTHER PUBLICATIONS

International Search Report and Written Opinion of the International Searching Authority for International Application No. PCT/US2014/056433.
(Continued)

*Primary Examiner* — Stephen F Husar
(74) *Attorney, Agent, or Firm* — Ashley Law Firm P.C.; Stephen S. Ashley, Jr.

(57) ABSTRACT

A container apparatus includes a container and a light assembly. The light assembly can include four elongate light members. The container can include a rectangular base and a rectangular sidewall extending upwardly from the base. The sidewall defines four corners of the container, and four elongate recesses are formed in the sidewall proximate the four corners of the sidewall to receive the elongate light members. The recesses are sized and shaped to conform to the elongate light members so that the light members can be releasably retained within the elongate recesses.

20 Claims, 13 Drawing Sheets

Related U.S. Application Data continuation-in-part of application No. 14/031,260, filed on Sep. 19, 2013, now Pat. No. 8,931,910.

(51) Int. Cl.
*F25D 3/08* (2006.01)
*A45C 15/06* (2006.01)

(52) U.S. Cl.
CPC ..... *F25D 3/08* (2013.01); *F25D 27/00* (2013.01); *A45C 15/06* (2013.01); *F25D 2331/804* (2013.01); *F25D 2400/36* (2013.01)

(56) References Cited

U.S. PATENT DOCUMENTS

| | | | | |
|---|---|---|---|---|
| 6,182,462 | B1 | 2/2001 | Bania et al. | |
| 6,997,007 | B1 | 2/2006 | Wyatt | |
| 7,080,920 | B2 | 7/2006 | Fitzsimmons et al. | |
| 7,645,047 | B2 | 1/2010 | Martinez | |
| 7,722,204 | B1 | 5/2010 | Sandberg | |
| 7,984,997 | B1 | 7/2011 | Sandberg | |
| 8,092,034 | B2 * | 1/2012 | Zarian | F21V 33/006 362/145 |
| 8,210,702 | B1 | 7/2012 | Sandberg | |
| 8,511,846 | B1 | 8/2013 | Sandberg | |
| 8,931,910 | B1 * | 1/2015 | Brown | F21V 33/008 362/92 |
| 9,568,186 | B2 * | 2/2017 | Brown | F21V 33/0044 |
| 2003/0081408 | A1 | 5/2003 | Tai | |
| 2005/0047118 | A1 | 3/2005 | Spahr et al. | |
| 2007/0103895 | A1 | 5/2007 | Riesebosch | |
| 2007/0206372 | A1 | 9/2007 | Casillas | |
| 2013/0033854 | A1 | 2/2013 | Statham | |
| 2017/0146228 | A1 * | 5/2017 | Brown | F21V 33/008 |

OTHER PUBLICATIONS

The International Bureau of WIPO, International Preliminary Report on Patentability in International Application No. PCT/US2014/056433, dated Mar. 22, 2016.

espacenet.com, English translation of abstract of RU78632U1, Apr. 1, 2016.

* cited by examiner

CONTAINER APPARATUS AND METHOD OF USING SAME

CROSS REFERENCE TO RELATED APPLICATIONS

This application is a continuation-in-part of International Application No. PCT/US2014/056433, filed Sep. 19, 2014, which claims priority to U.S. patent application Ser. No. 14/031,260, filed Sep. 19, 2013, now U.S. Pat. No. 8,931,910, and this application is a continuation-in-part of U.S. patent application Ser. No. 14/031,260, filed Sep. 19, 2013 now U.S. Pat. No. 8,931,910. All of said applications are incorporated herein by reference.

TECHNICAL FIELD AND BACKGROUND OF THE INVENTION

The present invention relates to a container apparatus. One embodiment of the invention comprises an insulated cooler that is adapted to receive a removable lighting assembly. The lighting assembly can be secured in the cooler so that it does not move during use, and can be easily removed from the cooler when desired.

It is common when using a container, such as an insulated cooler or toolbox, for the user to desire a light to illuminate the interior of the container. For example, such a light can aid the user in getting a certain food item contained in a cooler or a particular tool in a toolbox at night or in a dimly lit area. Attempts have been made in the prior art to address this need. However, many such prior art devices comprise containers in which lights are electrically wired to the container itself. Such a system can be relatively expensive, and if the lights fail it is generally difficult and impractical to repair. Also, it can be relatively difficult to replace batteries in such containers.

SUMMARY OF THE INVENTION

Therefore, one object of the present invention is to provide a container apparatus that can receive and engage an assembly for illuminating the interior of the container. Another object of the invention is to provide a container apparatus having an interior lighting assembly that can be easily removed from the container when desired. Yet another object of the invention is to provide a container apparatus having an interior lighting assembly that need not be functionally connected to the container. These and other objects of the present invention can be achieved in various embodiments of the invention described below.

One embodiment of the invention comprises a container apparatus comprising an enclosure having an interior surface, and at least one substantially concave recess formed in the interior surface sized and shaped to receive and engage a light assembly for illuminating an interior area of the enclosure.

According to another embodiment of the invention, the enclosure comprises a rectangular base and a rectangular sidewall extending upwardly from the base defining four corners of the enclosure.

According to another embodiment of the invention, at least one elongate recess is formed at one of the four corners defined by the sidewall.

According to another embodiment of the invention, the container apparatus includes a light assembly having at least one elongate light member, which is positioned within the elongate recess.

According to another embodiment of the invention, each elongate light member comprises a cooling or heating element. The cooling or heating element can be battery powered.

According to another embodiment of the invention, the container apparatus includes at least one elongate member positioned within the elongate recess. The elongate recess comprises a cooling or heating element. The cooling or heating element can be battery powered.

According to another embodiment of the invention, four elongate recesses are formed at the four corners defined by the sidewall.

According to another embodiment of the invention, four elongate light members are positioned within the four elongate recesses.

According to another embodiment of the invention, the rectangular sidewall comprises an outer wall section and an inner wall section, the inner wall section having an upper edge positioned below an upper edge of the outer wall section, such that the upper edge of the inner wall section defines a rest platform.

According to another embodiment of the invention, four elongate recesses are formed at the four corners of the sidewall. The elongate recesses begin at the upper edge of the inner wall section and extending downwardly to the base.

According to another embodiment of the invention, the container apparatus includes a light assembly comprising a rectangular frame having a perimeter approximately equal to a perimeter defined by the rest platform and defining four corners corresponding to the corners of the enclosure, and four elongate light members extend downwardly from the rectangular frame member. The light members are attached at the corners of the frame and are positioned within the four elongate recesses of the enclosure.

According to another embodiment of the invention, the rectangular frame of the light assembly rests on the rest platform of the enclosure.

According to another embodiment of the invention, the enclosure is a thermally insulated cooler.

According to another embodiment of the invention, the container apparatus includes a lid pivotally attached to the enclosure. The lid can be operatively connected to the light assembly, such that the light assembly emits light when the lid is opened.

According to another embodiment of the invention, the container apparatus includes a lid having a transparent or translucent section. As such, light emitting from the light assembly can be visible through the lid.

According to another embodiment of the invention, the enclosure is a tool box.

According to another embodiment of the invention, a substantially circular shaped recess is formed in the base of the enclosure.

According to another embodiment of the invention, a light assembly comprising a circular shaped light is positioned within the circular recess. At least one attachment member is connected to a bottom surface of the light and is releasably attached to the base of the enclosure.

According to another embodiment of the invention, the attachment member is a suction cup, and a plurality of suction cups are connected to a bottom surface of the light.

Another embodiment of the invention comprises a container kit comprised of a light assembly having four elongate light members, and a container. The container comprises a rectangular base and a rectangular sidewall extending upwardly from the base. The sidewall defines four corners of the container, and four elongate recesses are formed in the sidewall proximate the four corners of the sidewall to receive the elongate light members. The recesses are sized and shaped to conform to the elongate light members so that the light members can be releasably retained within the elongate recesses.

According to another embodiment of the invention, the rectangular sidewall comprises an outer wall section and an inner wall section. The inner wall section has an upper edge positioned below an upper edge of the outer wall section, such that the upper edge of the inner wall section defines a rest platform.

According to another embodiment of the invention, the light assembly includes a rectangular frame having a perimeter approximately equal to the perimeter of the rest platform, and has four corners corresponding to the corners of the container. The four elongate light members are attached at the four corners of the frame, and the rectangular frame rests on the rest platform of the container.

A container apparatus according to another preferred embodiment of the invention comprises an enclosure having a base and at least one sidewall extending upwardly from the base. At least one recess is formed in an interior surface of the enclosure, and is sized and shaped to receive and engage a light assembly for illuminating an interior area of the enclosure. A lid can be pivotally attached to the sidewall and moveable between a closed position, in which the lid covers the interior of the enclosure and an open position, in which the interior of the enclosure is open and exposed. The lid can have an opening formed therethrough and a translucent or transparent insert section positioned within the opening, so that light emitted by the light assembly is visible through the insert section when the lid is in the closed position.

According to another embodiment of the invention, the insert section can have a logo formed thereon, such that the logo is illuminated by light emitted from the light assembly.

Another embodiment of the invention comprises a method of illuminating a container interior that includes providing a container comprising an interior surface having at least one recess formed therein, and a light assembly comprising at least one light member adapted to be received and retained within the recess. The light member is inserted into the recess and illuminates the interior area of the container;

According to another embodiment of the invention, the light assembly is removed from the container by pulling the light member out of the recess.

DESCRIPTION OF THE PREFERRED EMBODIMENTS OF THE INVENTION AND BEST MODE

Figure 1:
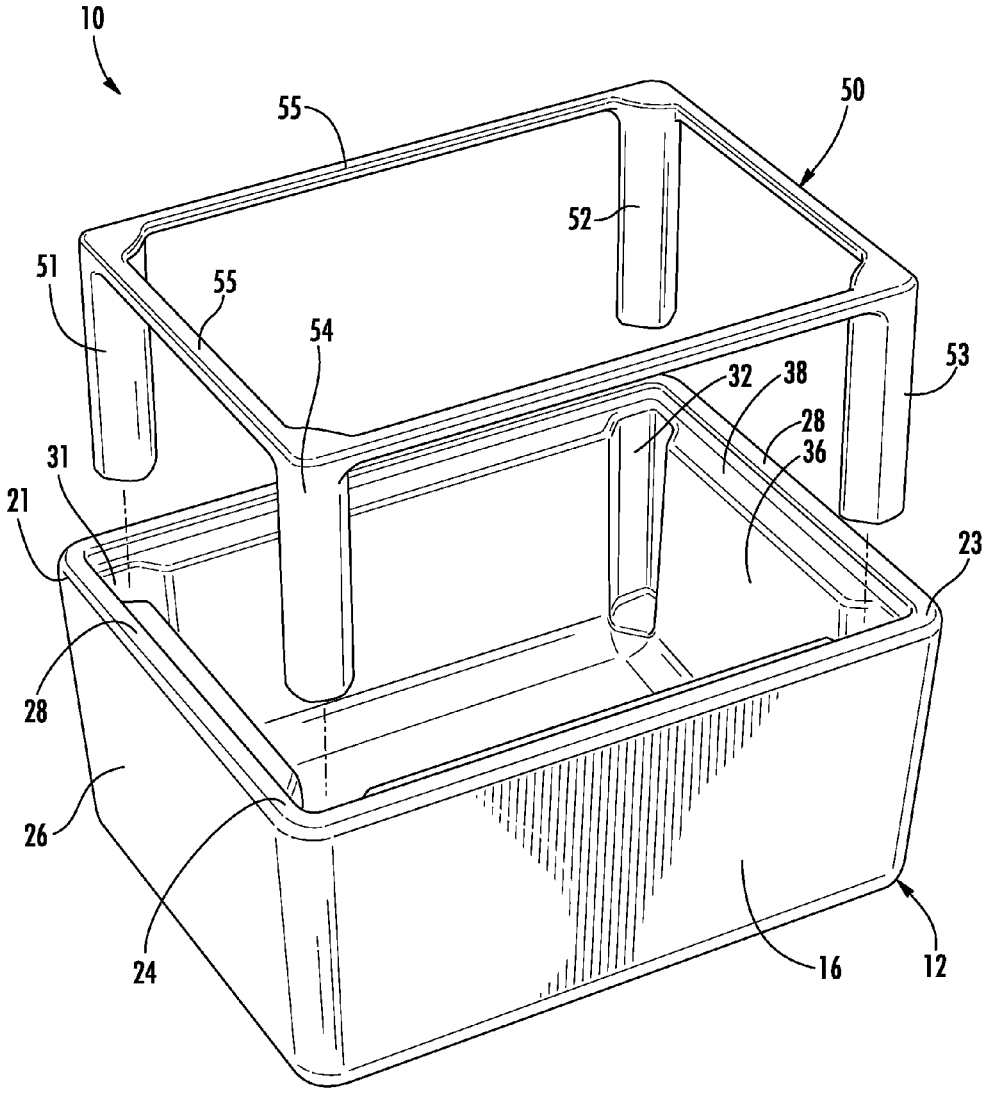
FIG. 1 is a perspective view of a container apparatus of according to a preferred embodiment of the invention.
Figure 2:
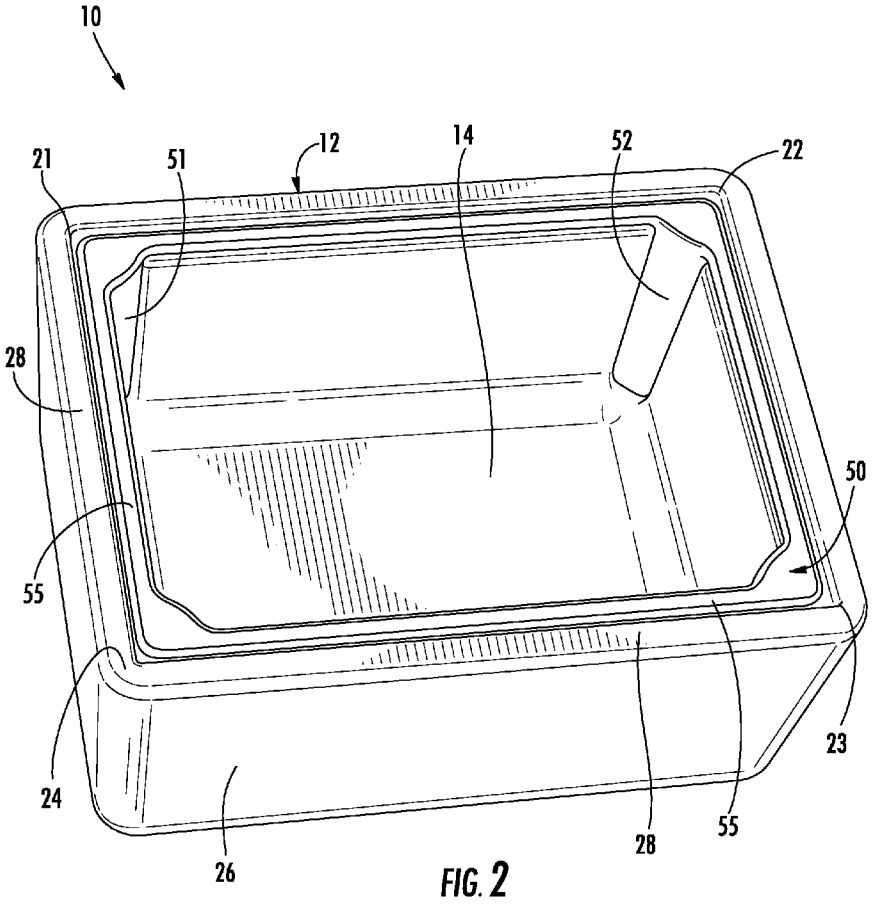
FIG. 2 is another perspective view of the container apparatus of FIG. 1.
Figure 3:
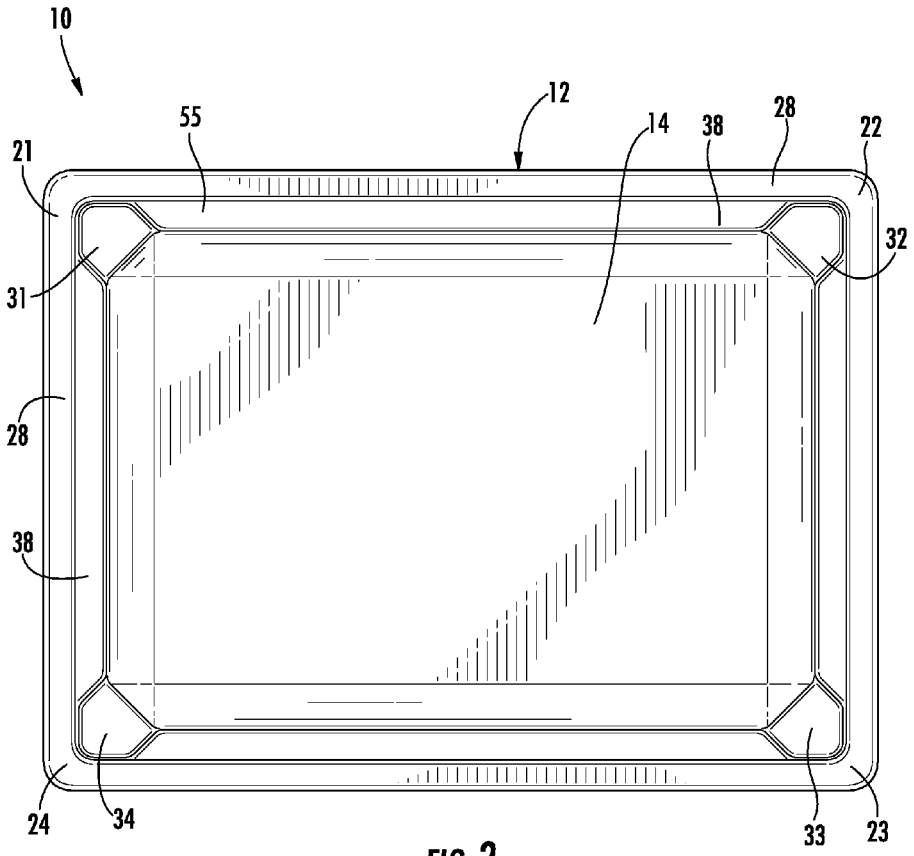
FIG. 3 is a top plan view of the container apparatus of FIG. 1, without a light assembly.

A container apparatus according to a preferred embodiment of the invention is illustrated in FIGS. 1-3, and shown generally at reference numeral 10. As shown in FIG. 1, the apparatus 10 comprises a container 12 and a light assembly insert 50. The word "container" as used herein refers generally to any kind of enclosure. For example, the container 10 can comprise a thermally insulated cooler adapted for storing food items and maintaining the food items. Alternatively, the container 10 can comprise a tool box for storing tools.

As shown in FIGS. 1-3, the container 12 comprises a substantially rectangular base 14, and a substantially rectangular sidewall 16 extending upwardly from the base 14. The sidewall 16 has four sides defining four corners 21, 22, 23, 24. The sidewall 16 is comprised of an outer wall section 26 and an inner wall section 36, as shown in FIGS. 1 and 2. The top 38 of the inner wall section 36 is lower than the top 28 of the outer wall section 26, thereby creating a tiered rest platform 38, as shown in FIG. 1. The container 12 can be made of plastic or other suitable material, and can be made by injection molding or other suitable manufacturing process.

Four substantially concave and elongate recesses 31, 32, 33, 34 are formed in the inner wall section 36 proximate the four corners 21, 22, 23, 24, respectively, of the sidewall 16, as shown in FIG. 1. The recesses 31, 32, 33, 34 begin at the top 38 of the inner wall section 36 and extend downwardly to the base 14 of the container 12, as shown at reference numeral 32 in FIG. 1. The recesses 31, 32, 33, 34 can have a substantially pentagonal shape, as shown in FIG. 3.

The light assembly 50 comprises four elongate light members 51, 52, 53, 54 attached a rectangular frame 55, as shown in FIG. 1. Each of the four light members 51 are attached at one of the four corners of the rectangular frame 55, and extend downwardly from the rectangular frame member at an angle of about ninety degrees, as shown in FIG. 1.

The elongate recesses 31, 32, 33, 34 in the container 12 are sized and shaped to conform to the elongate light members 51, 52, 53, 54, in order to receive and retain the light members 51, 52, 53, 54 therein. Accordingly, light members 51, 52, 53, 54 have a length approximately equal to the length of the recesses 31, 32, 33, 34 extending from the top 38 of the inner wall section 36 to the base 14, and have a perimeter slightly less than the effective perimeter of the recesses 31, 32, 33, 34, such that the light members 51, 52, 53, 54 can be inserted into the recesses 31, 32, 33, 34, as shown in FIGS. 1 and 2, and retained within the recesses 31, 32, 33, 34 by frictional engagement.

The rectangular frame 55 of the light assembly 50 has a perimeter approximately equal to the perimeter of the rectangular rest platform 38. As such, the frame 55 rests on the rest platform 38 if the inner wall section 36 when the light members 51, 52, 53, 54 are fully inserted into the recesses 31, 32, 33, 34, as shown in FIG. 2. The frame 55 has a height approximately equal to the difference in height between the top edge 28 of the outer wall section 26 and the top edge 38 of the inner wall section 36, such that the top of the frame 55 sits flush with the top 28 of the outer wall section 26 when the light members 51, 52, 53, 54 are fully inserted into the recesses 31, 32, 33, 34, as shown in FIG. 2.

Alternative embodiments can utilize an additional engagement mechanism for facilitating retention of the light members 51, 52, 53, 54 within the recesses 31, 32, 33, 34. For example, a plurality of protuberances can be positioned on the outer surface of the light members 51, 52, 53, 54 to engage a plurality of corresponding openings formed on the portion of the inner wall section 36 defining the recesses 31, 32, 33, 34 when the light members 51, 52, 53, 54 are fully inserted into the recesses 31, 32, 33, 34. The protuberances residing within the openings further retain the light members 51, 52, 53, 54 within the recesses 31, 32, 33, 34. Alternatively, a plurality of protuberances can be formed on the portion of the inner wall section 36 defining the recesses 31, 32, 33, 34 to engage a plurality of corresponding apertures formed in the light members 51, 52, 53, 54 when the light members 51, 52, 53, 54 are inserted into the recesses 31, 32, 33, 34.

Each elongate light member 51, 52, 53, 54 is comprised of a light emitting device, such as a light emitting diode (LED), a low-voltage incandescent light bulb, illuminated fiber optic cables, or other suitable light emitting device. As such, whenever it is desired to illuminate the interior of the container 12, the light assembly 50 is positioned within the container 12 by inserting the light members 51, 52, 53, 54 inserted into the recesses 31, 32, 33, 34, as shown in FIGS. 1 and 2, and turning on the light emitting devices of the light members 51, 52, 53, 54. In an alternative embodiment, each light member 51, 52, 53, 54 can include a battery powered cooling or heating element. In another alternative embodiment, each elongate member 51, 52, 53, 54 comprises a battery powered cooling or heating element, with no light emitting device.

Preferably, the light emitting device is powered by disposable or rechargeable batteries. The light emitting devices can be set on a timer such that they automatically turn off after a certain period of time to avoid draining of the batteries. The light assembly 50 is not wired to or otherwise electrically connected to the container 12, and no electric wiring is located within the container 12. As such, the light assembly 50 can be easily removed from the container 12 to repair a malfunction in one of the light members 51, 52, 53, 54, or replace drained batteries. Also, the light assembly 50 can be removed when there is no desire for illumination within the container 12 or when it is desired to replace the light assembly 50 with a new unit. Since the light assembly 50 is not operatively connected to or functionally dependent upon the container 12, and can be easily removed from the container 12, the light assembly 50 and container 12 can be manufactured, distributed and/or sold as separate units. Alternatively, the light assembly 50 and container 12 can be distributed and/or sold as components of a container kit.

Figure 12:
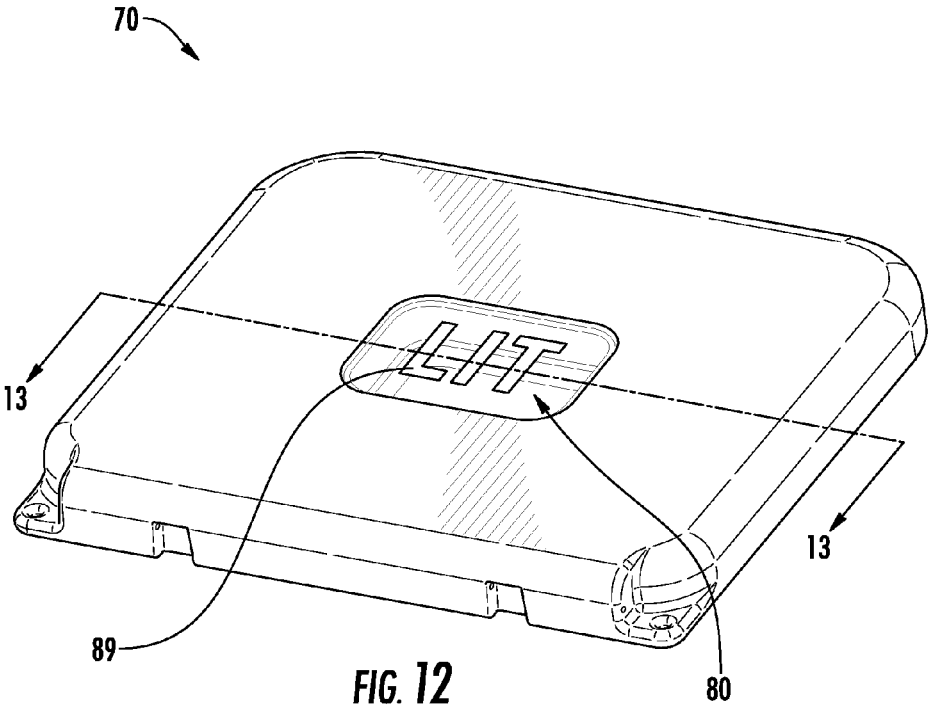
FIG. 12 is a perspective view of a lid portion of a container apparatus according to a preferred embodiment of the invention.
Figure 13:
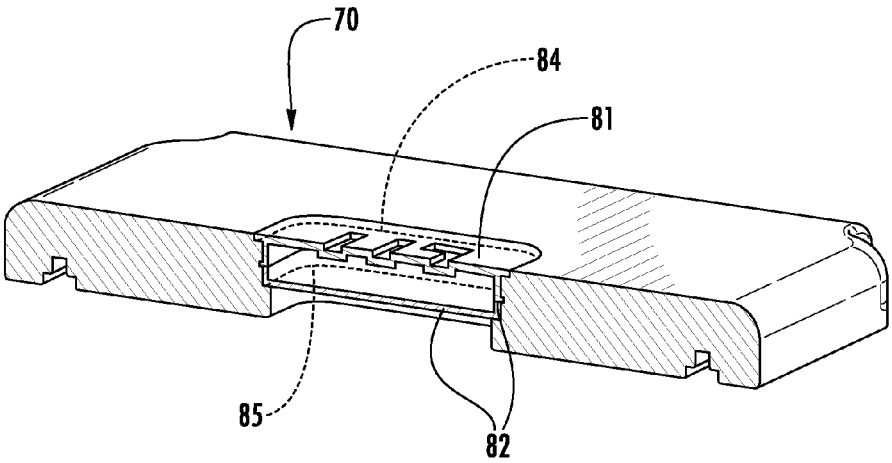
FIG. 13 is a cross sectional perspective view of the lid of FIG. 12, taken along lines 13-13 in FIG. 12.
Figure 14:
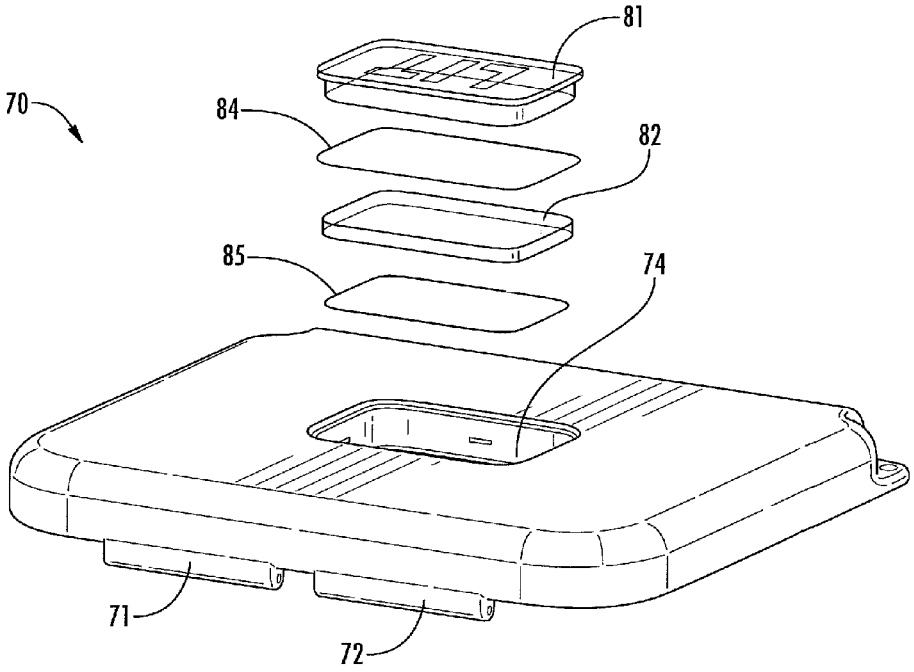
FIG. 14 is an exploded perspective view of the lid of FIG. 12.
Figure 15:
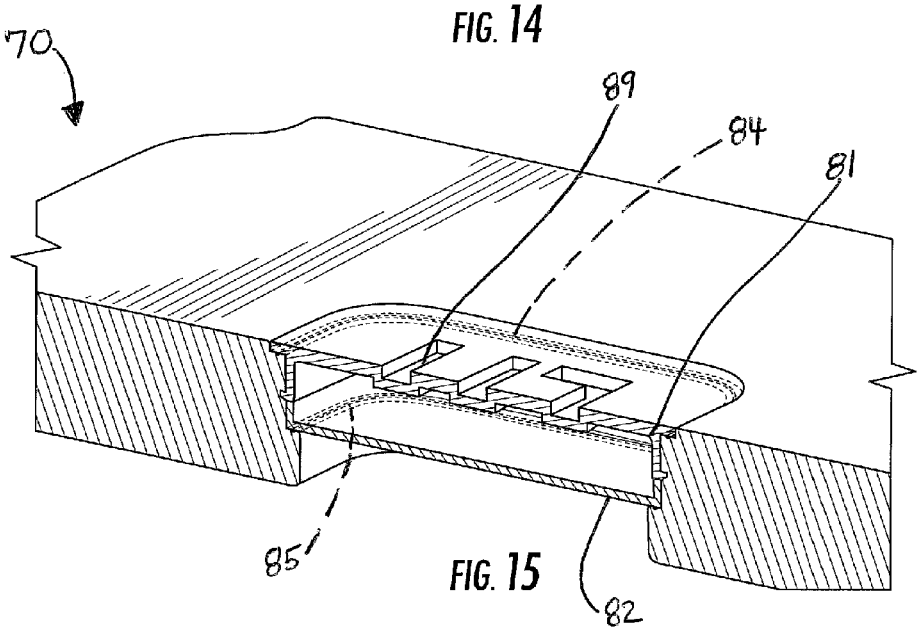
FIG. 15 is an enlarged partial perspective view of the lid of FIG. 12.
Figure 16:
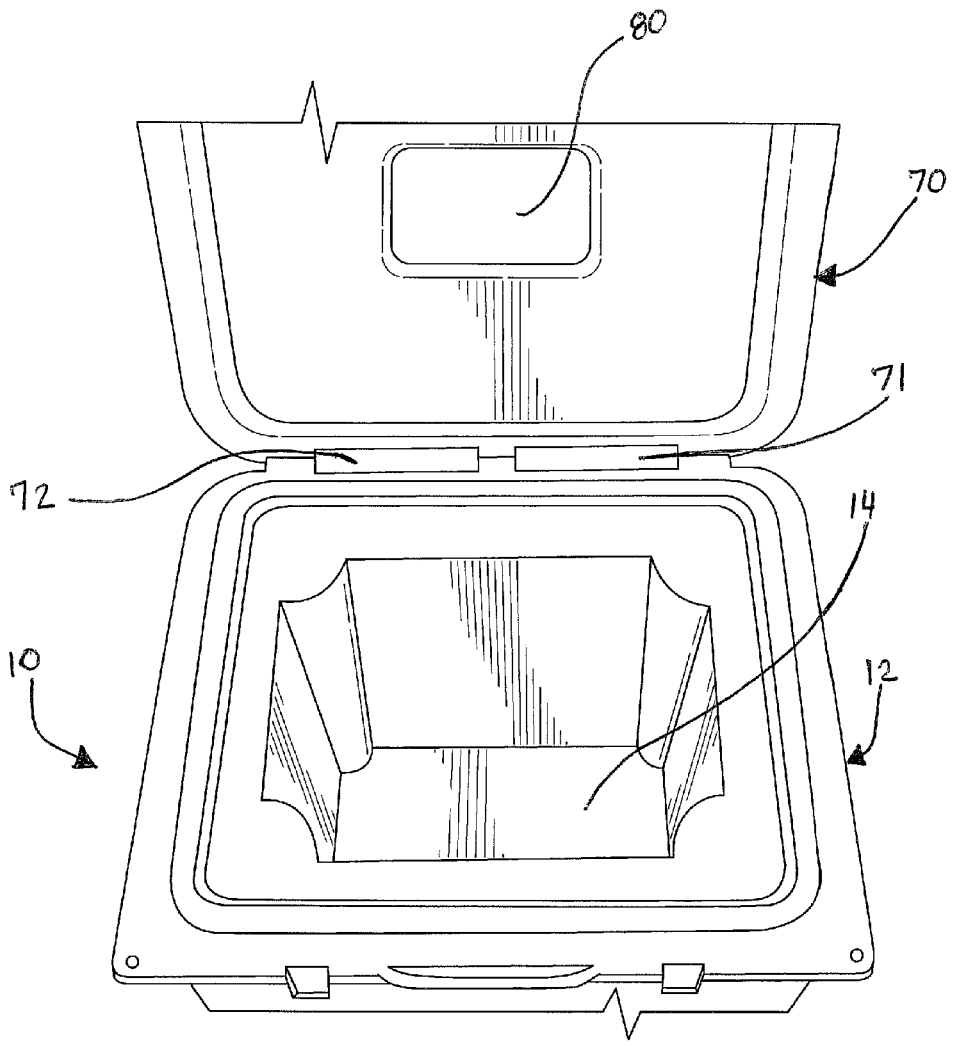
FIG. 16 is a perspective view of a container apparatus with a lid according to a preferred embodiment of the invention.

In an alternative embodiment, the apparatus 10 can include a lid 70, shown in FIGS. 12-16. The lid 70 can be pivotally attached to top of the sidewall 16 of the container 10 via two hinge members 71, 72, shown in FIGS. 14 and 16. The lid 70 can be operatively connected to the light assembly 50, so that the light assembly 50 comes on when the lid 70 is opened. Alternatively, the lid 70 can be operatively connected to the light assembly 50, such that the light assembly 50 comes on when the lid is closed. The lid 70 includes a center insert 80 positioned within a central opening 74 formed in the center of the lid 70, as shown in FIGS. 12-14. The center insert 80 and the central opening 74 can be substantially rectangular, as shown in FIGS. 12 and 14. The center insert 80 is comprised of an upper insert section 81 and a lower insert section 82, and two sealing rings 84, 85. The insert sections 81, 82 are made of a transparent or translucent material, such as polycarbonate plastic. The sealing rings 84, 85 are made of a sealing material, such as injection molded silicone. One sealing ring 84 is positioned along a recessed top edge of the central opening 74, below the top surface of the upper insert section 81, as shown in FIGS. 13 and 15. The other sealing ring 85 is positioned below the lower insert section 82 on a recessed ledge formed within the central opening 74, as shown in FIG. 13. Because the insert sections 81, 82 are translucent or transparent, light emitting from the light assembly 50 is visible through the insert section 80. A logo 89, shown as "LIT" in FIG. 12, can be engraved on the top surface of the upper insert section 81. The logo 89 can comprise any alphanumeric characters and/or graphics, such as a company name, trademark, sports team and/or school name or insignia. Light emitting from the light assembly 50 can shine through the insert 80 when the lid 70 is closed on the container 10, thereby illuminating the logo 89 and making it more visible. It should be noted that while the lid 70 is described above as being a part of container 10, the lid 70 can also be used with other embodiments of the invention, including the container 100 described below.

Figure 4:
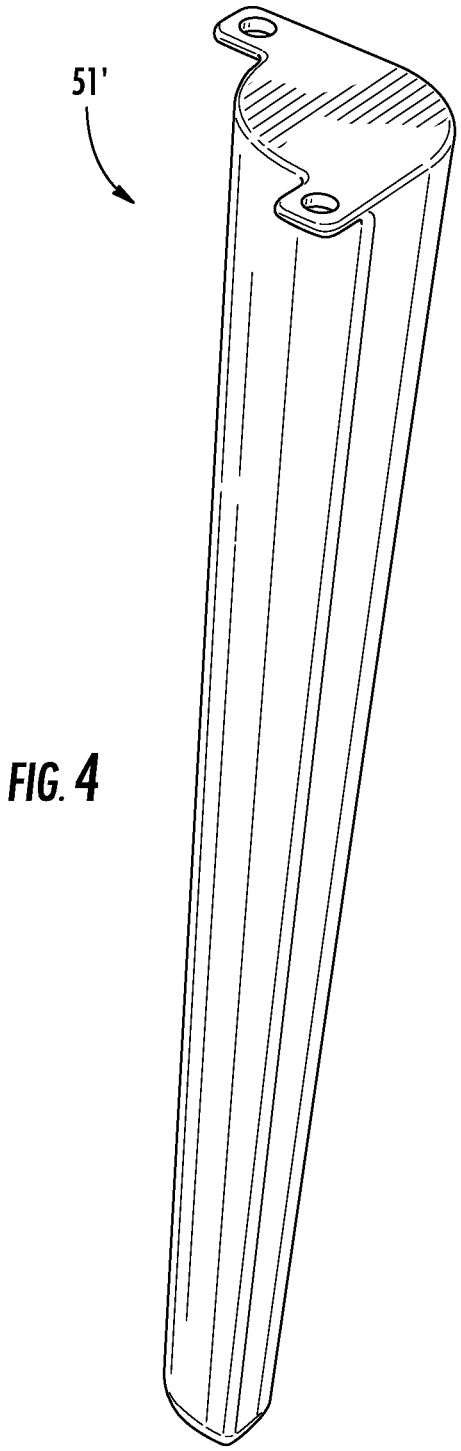
FIG. 4 is a perspective view of a light assembly according to another preferred embodiment of the invention.
Figure 5:
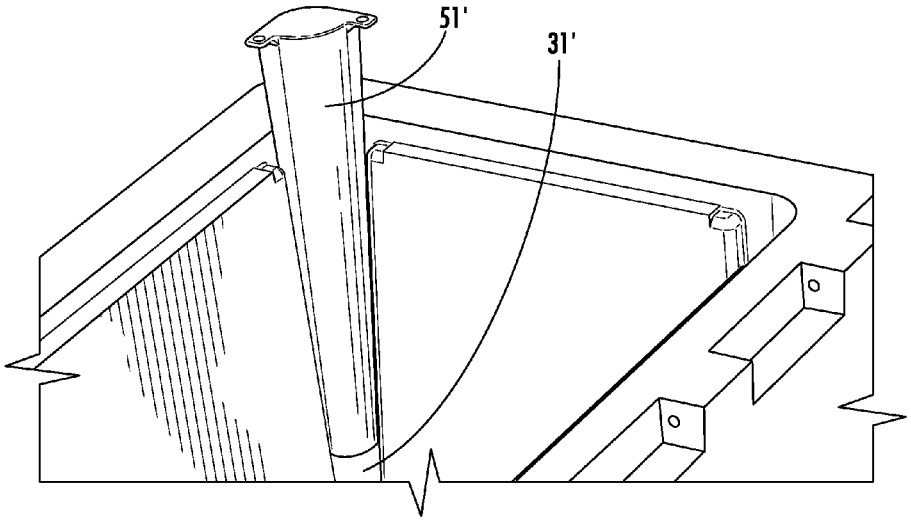
FIG. 5 is a partial perspective view of a container apparatus according to another preferred embodiment of the invention.
Figure 6:
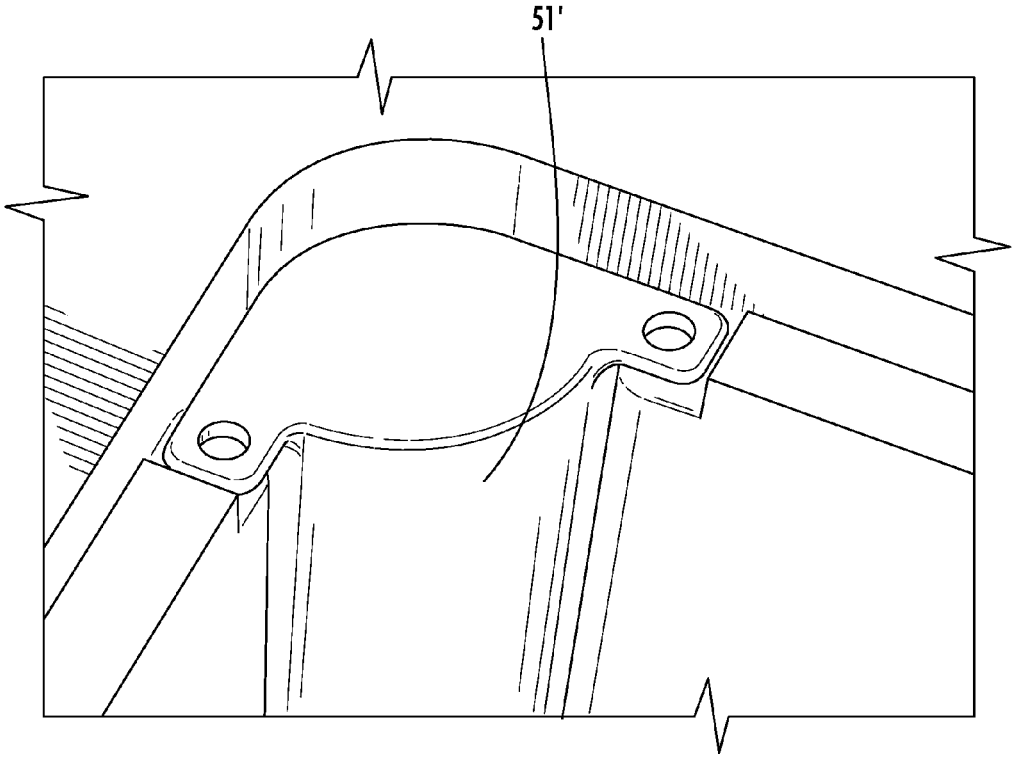
FIG. 6 is another partial perspective view of the container apparatus of FIG. 5.

In another preferred embodiment of the invention, shown in FIGS. 4-6, the light assembly comprises a plurality of separate elongate light members 51'. As such, the light assembly does not include a rectangular frame joining the light members 51' together, as in the previously described light assembly 50. In this alternative embodiment, each light member 51' is separately positioned into a recess 31', as shown in FIGS. 5 and 6.

A container apparatus according to another preferred embodiment of the invention is illustrated in FIGS. 7-11, and shown generally at reference numeral 100. As shown in FIG. 1, the apparatus 10 comprises a container 112 and a light assembly 150.

Figure 7:
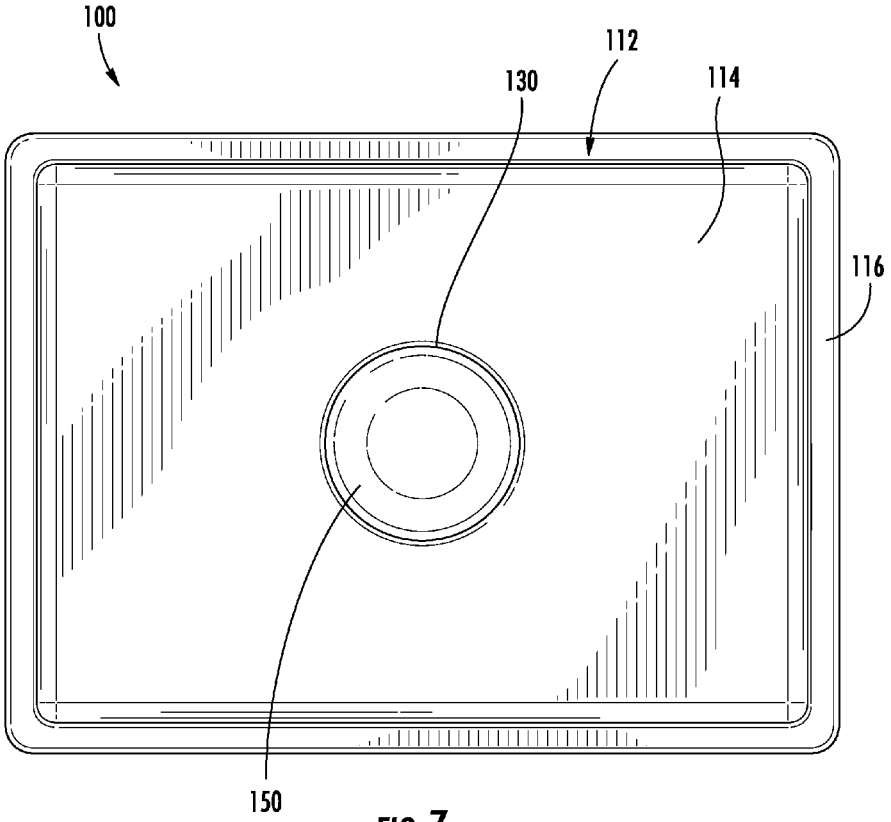
FIG. 7 is a top plan view of a container apparatus according to another preferred embodiment of the invention.
Figure 8:
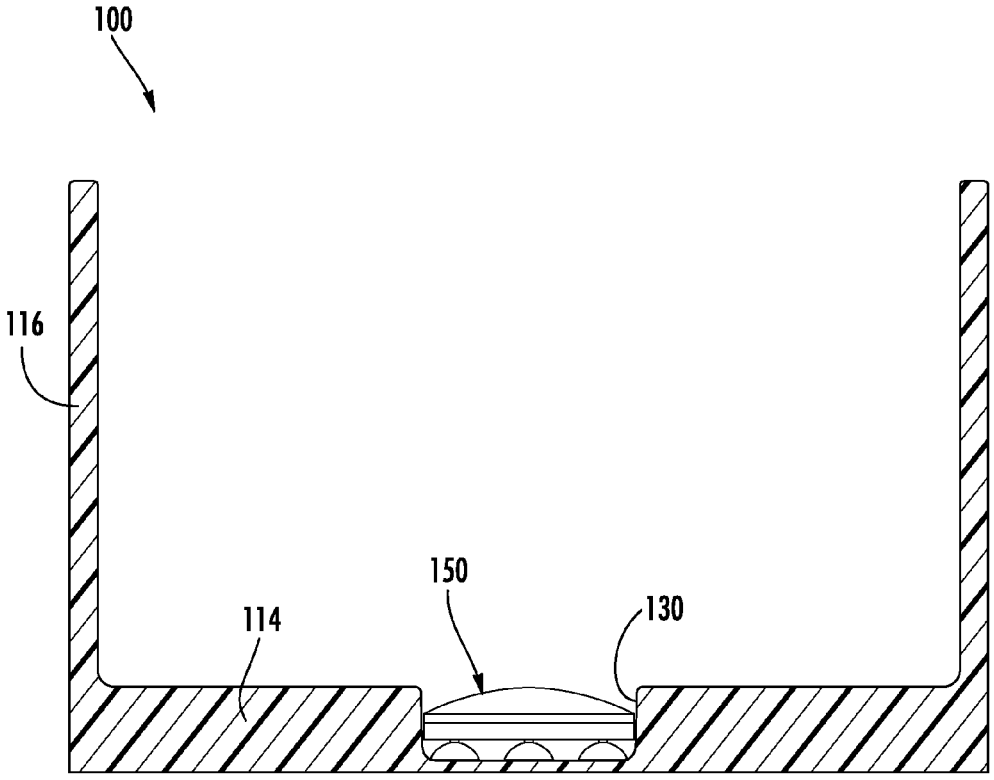
FIG. 8 is a side cross sectional view of the container apparatus of FIG. 7.

As shown in FIG. 7, the container 112 comprises a substantially rectangular base 114, and a substantially rectangular sidewall 116 extending upwardly from the base 14. A concave recess 130 is formed proximate the center of the base, as shown in FIG. 8. The recess 130 can have a circular shape, as shown in FIG. 7.

Figure 9:
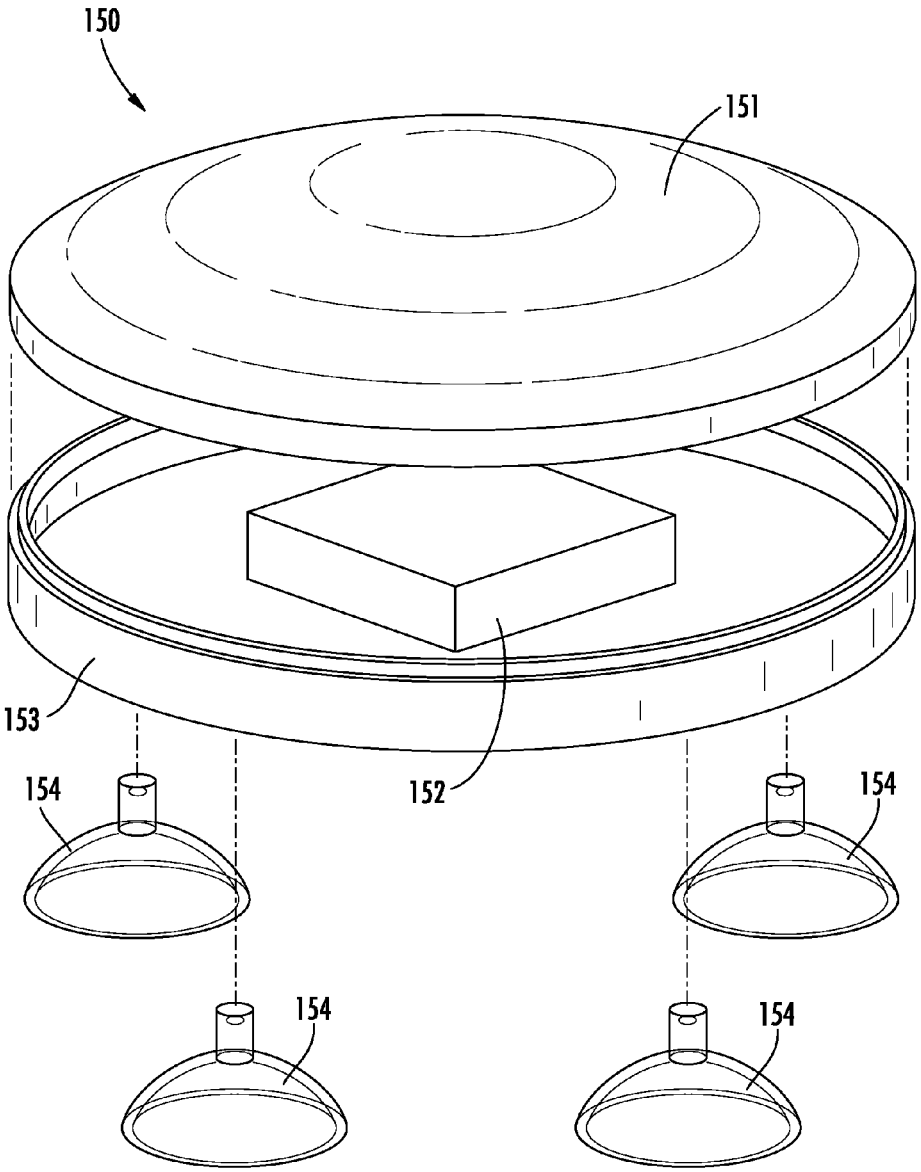
FIG. 9 is an exploded cross sectional view of a light assembly according to another preferred embodiment of the invention.
Figure 10:
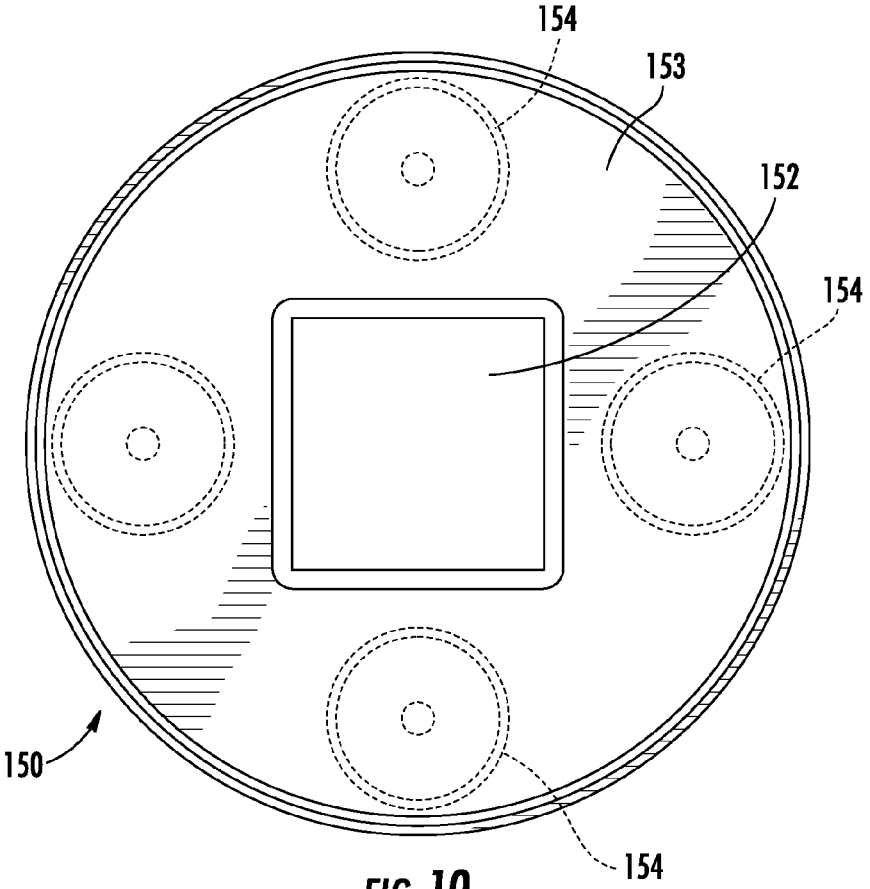
FIG. 10 is a top plan view of the light assembly of FIG. 9.
Figure 11:
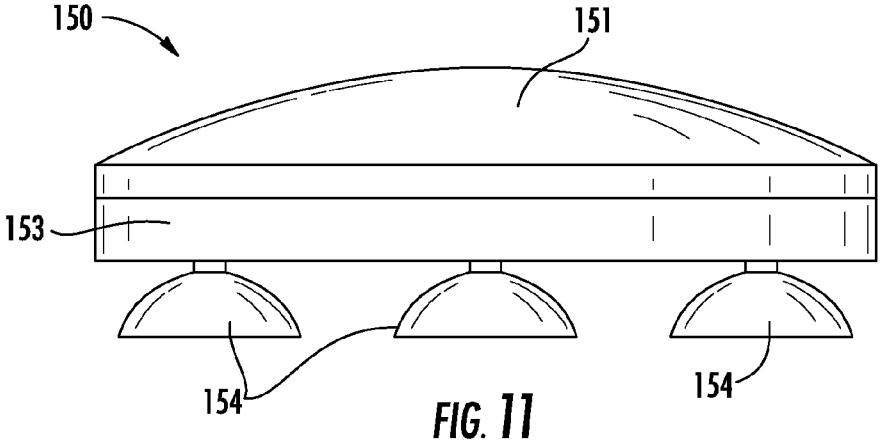
FIG. 11 is a side elevation of the light assembly of FIG. 9.

As shown in FIGS. 9-11, the light assembly 150 comprises a disc shaped light emitting member 151 containing a battery compartment 152, and a plurality of suction cups 154 attached to the base section 153 of the light emitting member 151. The light emitting member 151 can be comprised of any light emitting device, such as a light emitting diode (LED), an incandescent light bulb, or illuminated fiber optic cables.

As shown in FIG. 8, the light assembly 150 can be positioned within the circular recess 130 formed in the center of the base 114. Firmly pressing down on the light assembly 150 causes suction cups 154 to engage the base 114, and prevent the light assembly from coming out of the recess 130 during transport of the container 112.

It should be noted that the invention is not limited to the embodiments described above. In particular, the light assembly of the invention can be a variety of sizes and shapes, and the container can have one or more recesses sized and shaped to compliment the particular size and shape of the light assembly and facilitate insertion of the light assembly into the container. For example, the light assembly can comprise one or more rectangular panels containing light emitting devices that are inserted into one more recesses in the container. U.S. Provisional Application Ser. No. 61/204,016, filed Jan. 2, 2009, titled "LIGHTED ENCLOSURE ASSEMBLY", is incorporated herein by reference.

A container apparatus and a method of using same are described above. Various changes can be made to the invention without departing from its scope. The above description of the preferred embodiments and best mode of the invention are provided for the purpose of illustration only and not limitation—the invention being defined by the following claims and equivalents thereof.

What is claimed is:

1. A container apparatus comprising an enclosure having an interior surface, and at least one substantially concave recess formed in the interior surface sized and shaped to receive and engage a light assembly for illuminating an interior area of the enclosure, wherein the enclosure comprises at least one from the group consisting of a thermally insulated cooler and a tool box.

2. The container apparatus according to claim 1, wherein the enclosure comprises a substantially rectangular base and a substantially rectangular sidewall extending upwardly from the base defining four corners of the enclosure.

3. The container apparatus according to claim 2, wherein the at least one substantially concave recess is substantially elongate and formed at one of the four corners defined by the sidewall.

4. The container apparatus according to claim 3, further comprising a light assembly, the light assembly comprising at least one elongate light member positioned within the at least one recess.

5. The container apparatus according to claim 4, wherein the light assembly comprises at least one selected from the group consisting of a cooling element and a heating element.

6. The container apparatus according to claim 2, wherein the at least one recess comprises four recesses formed at the four corners defined by the sidewall.

7. The container apparatus according to claim 6, further comprising a light assembly comprising four elongate light members positioned within the four recesses.

8. The container apparatus according to claim 2, wherein the rectangular sidewall comprises an outer wall section and an inner wall section, the inner wall section having an upper edge positioned below an upper edge of the outer wall section, wherein the upper edge of the inner wall section defines a rest platform.

9. The container apparatus according to claim 8, wherein the at least one recess comprises four substantially elongate recesses formed at the four corners defined by the sidewall, the recesses beginning at the upper edge of the inner wall section and extending downwardly to the base.

10. The container apparatus according to claim 9, further comprising a light assembly comprising a rectangular frame having a perimeter approximately equal to a perimeter defined by the rest platform and defining four corners corresponding to the corners of the enclosure, and four elongate light members extending downwardly from the rectangular frame member, the light members attached at the corners of the frame and positioned within the four elongate recesses of the enclosure.

11. The container apparatus according to claim 10, wherein the rectangular frame of the light assembly rests on the rest platform of the enclosure.

12. The container apparatus according to claim 1, wherein the at least one recess comprises a substantially circular shaped recess formed in a base of the enclosure.

13. The container apparatus according to claim 12, further comprising a light assembly comprising a circular shaped light positioned within the substantially circular recess, and including at least one attachment member connected to a bottom surface of the light and releasably attached to the base of the enclosure.

14. The container apparatus according to claim 2, further comprising a lid pivotally attached to the sidewall and moveable between a closed position wherein the lid covers an interior area of the container and an open position wherein the interior area of the container is exposed, the lid having an opening formed therethrough and an insert section positioned within the opening, the insert section being translucent or transparent, whereby light emitted by the light assembly is visible through the insert section when the lid is in the closed position.

15. A container kit comprising:

(a) a light assembly comprising at least one elongate light member;

(b) a container comprising a substantially rectangular base and a substantially rectangular sidewall extending upwardly from the base, and at least one elongate recess formed in an interior surface of the sidewall for receiving the at least one elongate light member, wherein the at least one recess is sized and shaped to conform to the at least one elongate light member whereby the at least one elongate light member is releasably retained within the at least one elongate recess; and (c) a lid pivotally attached to the sidewall and moveable between a closed position wherein the lid covers an interior area of the container and an open position wherein the interior area of the container is exposed, the lid having an opening formed therethrough and an insert section positioned within the opening, the insert section being translucent or transparent, whereby light emitted by the light assembly is visible through the insert section when the lid is in the closed position.

16. The container kit according to claim 15, wherein the container comprises at least one from the group consisting of a thermally insulated cooler and a tool box.

17. The container kit according to claim 15, wherein the insert section includes a logo positioned thereon, wherein the logo is illuminated by the light emitted from the light assembly.

18. A container apparatus comprising:

(a) an enclosure comprising a base and at least one sidewall extending upwardly from the base;

(b) at least one substantially concave recess formed in an interior surface of the enclosure sized and shaped to receive and engage a light assembly for illuminating an interior area of the enclosure; and (c) a lid pivotally attached to the sidewall and moveable between a closed position wherein the lid covers an interior area of the enclosure and an open position wherein the interior area of the enclosure is exposed, the lid having an opening formed therethrough and an insert section positioned within the opening, the insert section being translucent or transparent, whereby light emitted by the light assembly is visible through the insert section when the lid is in the closed position.

19. The container apparatus according to claim 18, wherein the insert section includes a logo formed thereon, wherein the logo is illuminated by light emitted from the light assembly.

20. The container apparatus according to claim 18, wherein the insert section comprises polycarbonate plastic, and includes at least one sealing ring.

* * * * *